United States Patent [19]

Smith

[11] 4,322,019

[45] Mar. 30, 1982

[54] FLUID INJECTION POUCH AND DISPENSING SYSTEM INCORPORATING THE SAME

[75] Inventor: Randel P. Smith, Chicago, Ill.

[73] Assignee: Steiner Corporation, Salt Lake City, Utah

[21] Appl. No.: 10,013

[22] Filed: Feb. 7, 1979

[51] Int. Cl.[3] ..... B67B 7/24

[52] U.S. Cl. ..... 222/83.5; 141/114; 141/330; 222/107

[58] Field of Search ..... 222/80, 81, 83, 83.5, 222/87–91, 107; 141/18, 114, 329, 330; 206/603; 220/267, 277, 278

[56] References Cited

U.S. PATENT DOCUMENTS

| | | | |
|---|---|---|---|
| 2,849,321 | 8/1958 | Lhermitte et al. | 206/603 X |
| 3,128,913 | 4/1964 | Specketer | 222/107 |
| 3,220,588 | 11/1965 | Lipari | 206/222 |
| 3,255,923 | 6/1966 | Soto | 222/80 |
| 3,257,036 | 6/1966 | Micallef | 222/464 X |
| 3,596,801 | 8/1971 | Barnack | 222/81 |
| 3,995,773 | 12/1976 | Schmit | 222/91 |
| 4,018,363 | 4/1977 | Cassia | 222/80 |
| 4,149,573 | 4/1979 | Cassia | 141/18 |
| 4,173,858 | 11/1979 | Cassia | 141/18 |

FOREIGN PATENT DOCUMENTS

| | | | |
|---|---|---|---|
| 1295834 | 11/1972 | United Kingdom | 222/81 |

*Primary Examiner*—F. J. Bartuska

*Attorney, Agent, or Firm*—Dithmar, Stotland, Stratman & Levy

[57] ABSTRACT

A fluid injection pouch for use in refilling a dispenser having a refill well with refill apertures therein and a piercing member therein, the pouch having a flexible wall hermetically sealed for containing fluid, and a docking adaptor loosely disposed within the pouch and for insertion into the refill well so as to push the wall of the pouch upon the piercing member to pierce the wall and provide an opening for discharge of fluid from the pouch through the refill aperture and into an associated dispenser; there also is provided a fluid dispensing system incorporating such an injection pouch.

25 Claims, 10 Drawing Figures

FIG. 3
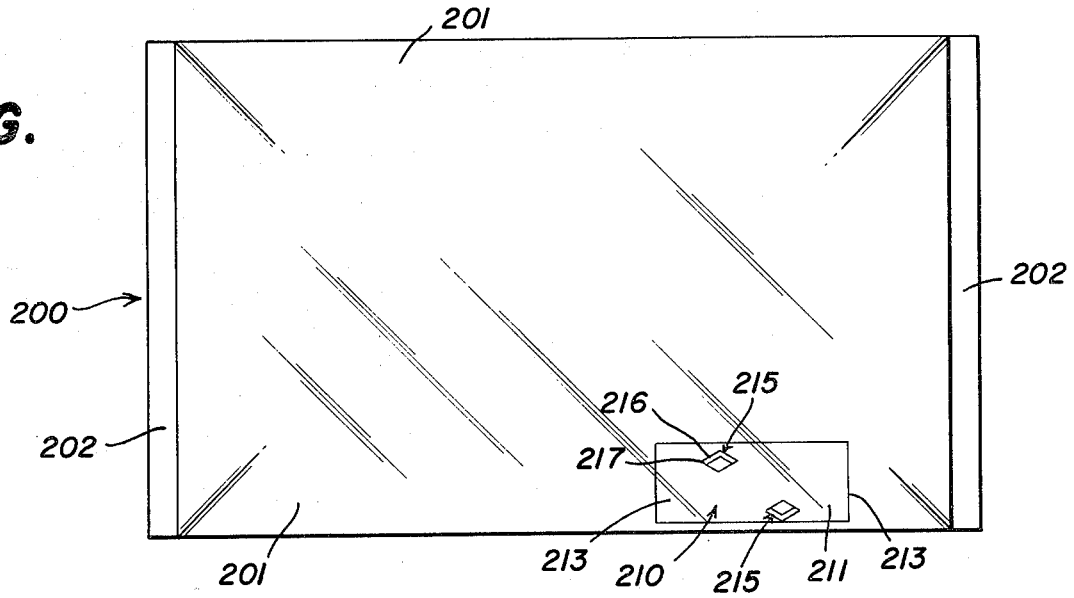
FIG. 4
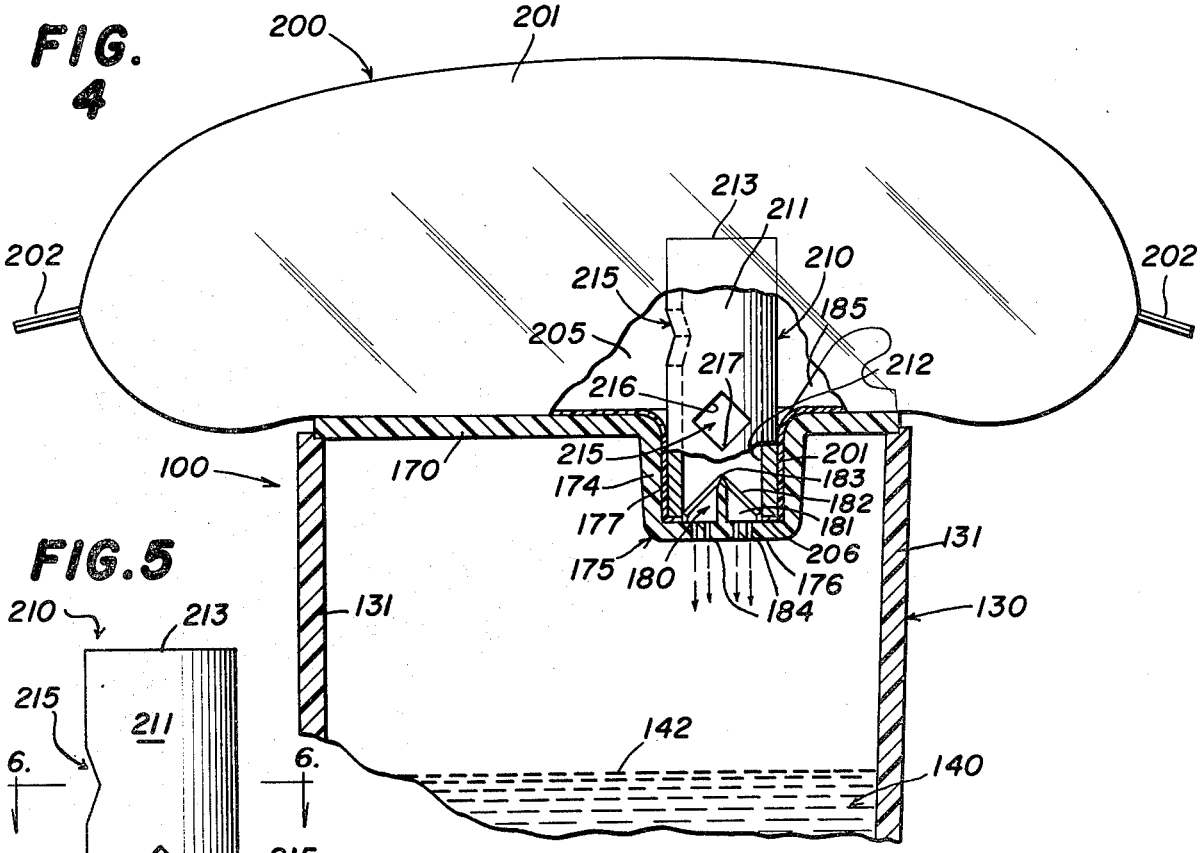
FIG. 5
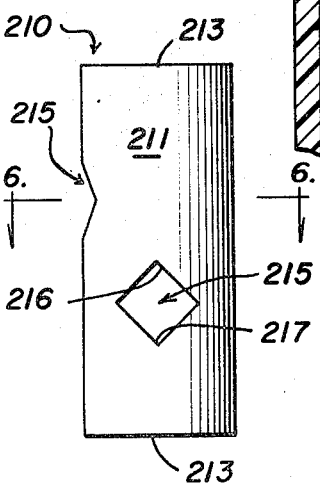
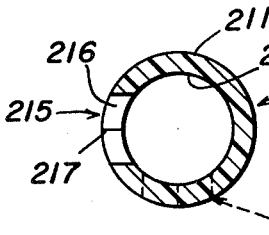
FIG. 6

FLUID INJECTION POUCH AND DISPENSING SYSTEM INCORPORATING THE SAME

PRIOR ART STATEMENT AND BACKGROUND OF THE INVENTION

The present invention relates generally to an improved fluid injection pouch for refilling fluid dispensers and to fluid dispensing systems incorporating such an injection pouch. More particularly, there is disclosed an improved viscous liquid soap injection pouch for refilling liquid soap dispensers and soap dispensing systems incorporating such an injection pouch. This invention is an improvement upon the soap dispensing system disclosed and claimed in an application for U.S. Letters Patent, Ser. No. 851,518 filed November 14, 1977 by Antonio Macchi Cassia for Soap Dispensing System, now U.S. Pat. No. 4,149,573 granted Apr. 17, 1979, the disclosure of that prior patent being incorporated herein in its entirety by reference. The present invention also is an improvement upon the soap dispensers and the refill systems therefor illustrated and claimed in U.S. Pat. No. 4,018,363 granted Apr. 19, 1977 to Antonio Macchi Cassia and in an application for U.S. Letters Patent, Ser. No. 880,766 filed Feb. 24, 1978 by Antonio Macchi Cassia for Soap Dispensing System, now U.S. Pat. No. 4,173,858 granted Nov. 13, 1979.

The two pending applications for U.S. Letters Patent both show cylindrical containers for liquid soap useful in refilling the soap container of a soap dispenser, and U.S. Pat. No. 4,018,363 also shows a cylindrical soap container that is incorporated into a soap dispenser to provide liquid soap therefor. Being cylindrical in configuration, the prior liquid soap refill structures are relatively expensive to fabricate and use and also are not economical in the use of storage space during the storage thereof.

There also have been provided heretofore flexible pouches with puncture structure therein, and typical structures are shown in U.S. Pat. No. 2,849,321 granted Aug. 26, 1958 to Y. Lhermitte et al., U.S. Pat. No. 3,220,588 granted Nov. 30, 1965 to M. Kipari, U.S. Pat. No. 3,255,923 granted June 14, 1966 to R. H. Soto, and U.S. Pat. No. 3,596,801 granted Aug. 3, 1971 to H. C. Barnack. None of these prior pouch systems and the puncture or adaptor structure therein were intended and designed to be used to force a viscous liquid through a refill well into an associated dispenser for the viscous liquid.

SUMMARY OF THE INVENTION

The present invention provides a fluid injection pouch for use in and as a part of novel fluid dispensing systems which facilitate refilling of the dispenser in the dispensing system in a tidy manner, the fluid injection pouch being economical in storage space during the storage thereof.

This is accomplished in the present invention, and it is an object of the present invention to accomplish these desired results, by providing a fluid injection pouch comprising a flexible encompassing wall sealed to form a hollow flexible container with a quantity of fluid therein, and a hollow and generally cylindrical docking adaptor loosely disposed within the pouch, the docking adaptor including an outer generally cylindrical wall and an inner generally cylindrical wall, said flexible encompassing wall being foldable about the docking adaptor to permit a user to grasp the docking adaptor to press one end thereof and an area of said flexible encompassing wall into a piercing docking adaptor device on a dispenser for connecting the interior of the fluid injection pouch with a dispenser for the contents thereof.

Another object of the invention is to provide a fluid injection pouch of the type set forth, wherein the docking adaptor has an essentially smooth outer wall.

Yet another object of the invention is to provide a fluid injection pouch of the type set forth, wherein the docking adaptor includes an annular flexible sealing means projecting radially outwardly from the docking adaptor.

A further object of the invention is to provide a system for dispensing fluid which incorporates therein a fluid injection pouch of the type set forth.

Further features of the invention pertain to the particular arrangement of the parts of the fluid injection pouch and the system for dispensing fluid, whereby the above outlined and additional operating features thereof are attained.

The invention both as to its organization and method of operation, together with further features and advantages thereof will best be understood with reference to the following specifications taken in connection with the accompanying drawings.

BRIEF DESCRIPTION OF THE DRAWINGS

FIG. 3 is a plan view of a fluid injection pouch made in accordance with and embodying the principles of the present invention;

FIG. 4 is a view partly in section and illustrating the manner in which the fluid injection pouch of FIG. 3 is utilized to refill the soap container in the soap dispenser of FIGS. 1 and 2;

FIG. 5 is a side elevational view of a first form of a tubular docking adaptor forming a part of the fluid injection pouch of FIG. 3;

FIG. 6 is a view in horizontal section along the line 6—6 of FIG. 5;

DESCRIPTION OF THE PREFERRED EMBODIMENTS

Figure 1:
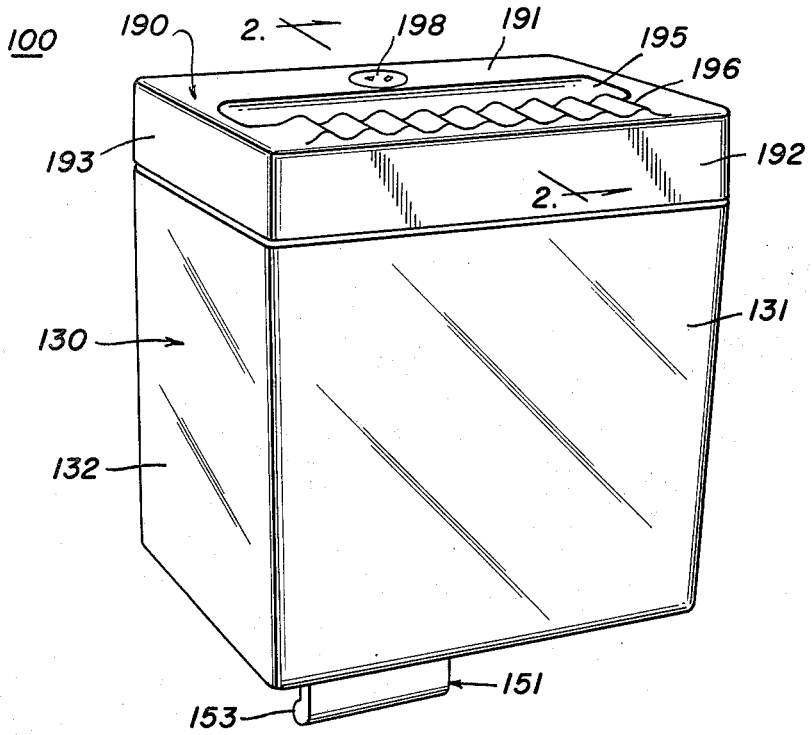
FIG. 1 is a front perspective view of a dispenser for fluid, and specifically liquid soap, forming a part of a fluid dispensing system made in accordance with and embodying the features of the present invention.
Figure 2:
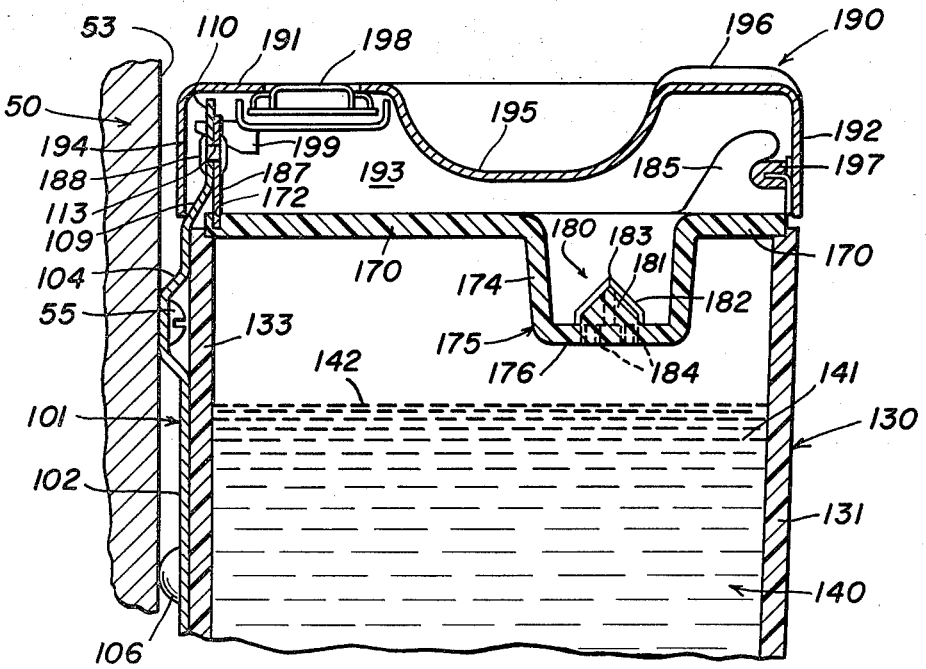
FIG. 2 is a fragmentary view in vertical section along the line 2—2 in FIG. 1 and illustrating the internal construction of the soap dispenser, and particularly the refill well and associated structure thereof.
Figure 8:
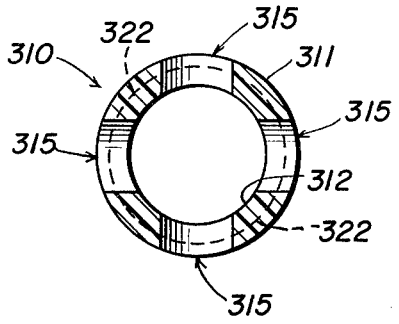
FIG. 8 is a view in horizontal section along the line 8—8 of FIG. 7.
Figure 7:
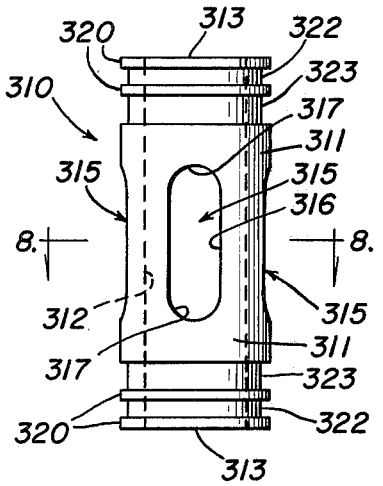
FIG. 7 is a side elevational view of a second form of tubular docking adaptor useful in the fluid injection pouch of the present invention.
Figure 9:
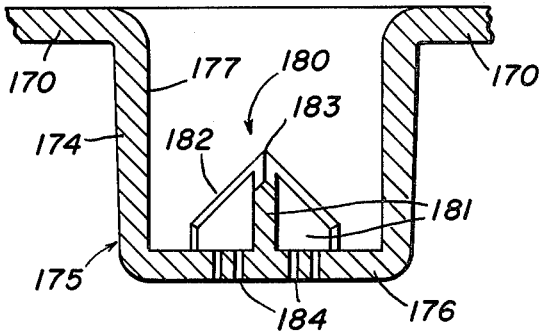
FIG. 9 is a fragmentary view in vertical section on an enlarged scale through the refill well forming a part of the soap dispenser of FIGS. 1 and 2.
Figure 10:
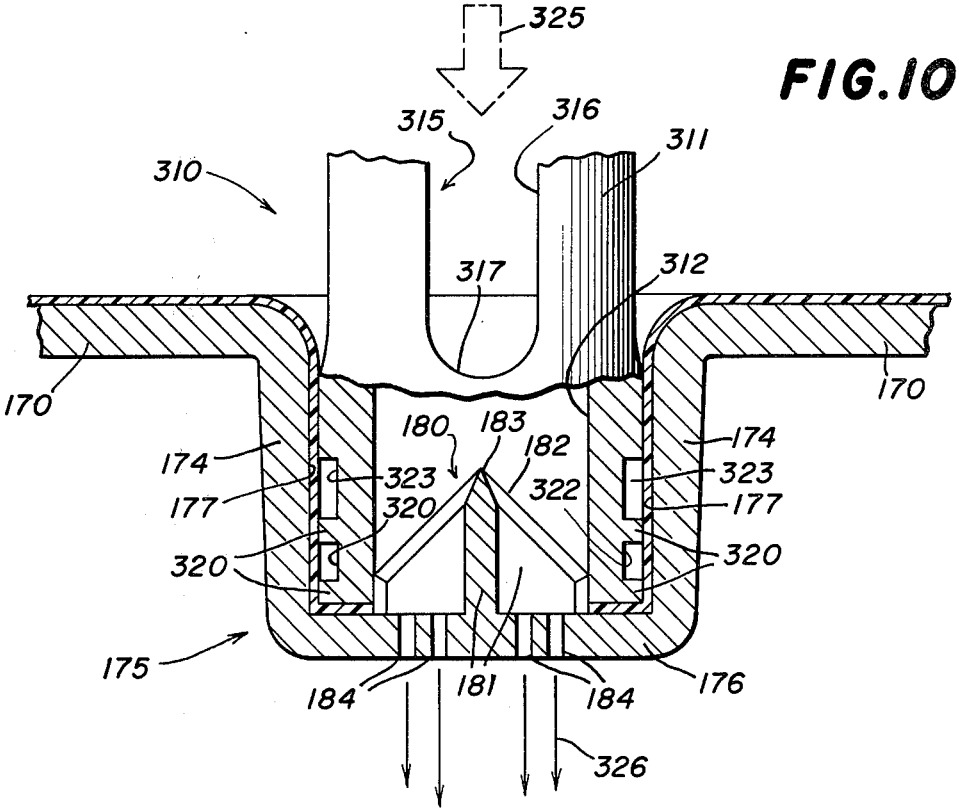
FIG. 10 is a further enlarged view illustrating the cooperation between the tubular docking adaptor of FIG. 7 and the wall of the associated injection pouch after insertion thereof into an associated refill well of a soap dispenser.

Referring to FIGS. 1 and 2 of the drawings, there is illustrated a vessel, and specifically a soap dispenser 100, with which a fluid injection pouch 200 of the present invention is useful, and which soap dispenser 100 and injection pouch 200 cooperate to provide the novel fluid dispensing system, and specifically a soap dispensing system, of the present invention. The details of the construction and operation of the soap dispenser 100 are fully set forth in the copending application for U.S. Letters Patent, Ser. No. 851,518 referred to above, now U.S. Pat. No. 4,149,573 the disclosure of which application is incorporated herein by reference. The following is a brief description of the portions of the soap dispenser 100 which most intimately cooperate with the fluid injection pouch 200 of the present invention to provide the new dispensing system of the present invention, the reference numerals in the present description being the same as those in Ser. No. 851,518 referred to above.

The soap dispenser 100 includes a mounting bracket 101 which has a flat rectangular wall 102 disposed substantially vertically and used to provide a bearing surface. Formed in the vertical wall 102 and projecting rearwardly therefrom are two substantially vertically aligned generally frusto-conical embossments 104, each having an opening 105 extending therethrough centrally thereof. Also formed in the wall 102 and projecting rearwardly therefrom are two part-spherical embossments 106 which are disposed substantially in horizontal alignment with each other, the embossments 106 projecting the same distance as the embossments 104. Integral with the wall 102 is an extension flange 109 that is inclined forwardly, and which is integral at the distal end thereof with an upwardly extending flange 110 which is substantially parallel to the wall 102. There is provided through the flange 110 a small circular centrally disposed opening 113.

In use, the mounting bracket 101 is mounted on a wall 50, generally above and closely adjacent to a sink or a wash basin or the like. Mounting openings or holes (not shown) are formed in the wall 50, and the mounting bracket 101 is fixedly secured to the wall 50 by means of mounting screws 55 which are passed through openings (not shown) in the embossments 104, the wall 102 being disposed substantially parallel to the surface 53 of the wall 50 and being in contact therewith only at the embossments 104 and 106, which serve to space the bracket 101 a slight distance from the surface 53 of the associated wall 50.

The dispenser 100 also includes a soap container or housing 130 which is preferably formed of plastic and is generally box-like in configuration. The container 130 includes a generally rectangular front wall 131, a pair of opposed side walls 132, a rear wall 133 and a rectangular bottom wall (not shown), the container 130 preferably being molded so that all the walls named are all formed integrally with one another. The walls of the container 130 cooperate to define therewith a soap chamber, generally designated by the numeral 140, which, in use, is filled with liquid soap 141 to a predetermined level, such as 142. Liquid soap is withdrawn from the container 130 by means of a pump assembly (not shown) which includes an operating handle 151 provided at the lower end thereof with an enlarged gripping portion 153. Actuation of the pump assembly by means of the operating handle 151 delivers a charge of soap from the soap container 130 to the user's hand disposed beneath the container 130 and in engagement with the operating handle 151.

The container 130 is also provided with a top wall 170 which is fixedly secured to the upper ends of the container walls 131, 132, and 133 for closing the upper end of the chamber 140. Formed in the upper surface of the top wall 170 adjacent to the rear edge thereof is a narrow groove or recess 172. Also formed in the top wall 170 is a deep cylindrical depending refill well 175 which is provided with a generally cylindrical side wall 174 closed at the bottom end thereof by a circular bottom wall 176. The side wall 174 has an inner surface 177 that is essentially cylindrical in configuration.

Integral with the bottom wall 176 of the refill well 175 and projecting upwardly therefrom substantially centrally thereof is a piercing member 180, the piercing member 180 comprising a cruciform arrangement of four flat blades or webs 181 respectively provided with knife edges 182 along the upper edges thereof which are inclined upwardly and inwardly to intersect at a point 183 disposed about half way up the vertical extent of the refill well 175. Formed in the bottom wall 176 and disposed between adjacent ones of the blades 181 are four groups of refill perforations or apertures 184 which extend through the bottom wall 176. It is a significant feature of the present invention that each of the refill apertures 184 has a cross-sectional area such that viscous liquid soap of the type to be dispensed from the dispenser 100 will not pass through the refill apertures 184 by gravity alone, or at best, will pass only very slowly therethrough. Integral with the top wall 170 and projecting inwardly therefrom adjacent to the front corners thereof are two lugs or ears 185, each being provided with an arcuate recess defining a retaining surface in the forward edge thereof.

Pivotally secured to the inner surface of the upwardly extending flange 110 of the mounting bracket 100, as by a rivet 108 extending through the opening 113, is a small retaining plate 187, preferably formed of steel or the like. The retaining plate 187 extends downwardly to a point adjacent to the bottom end of the inclined flange 109. In use, when the container 130 is being mounted on the mounting bracket 101, as the container rear wall 133 is moved back against the bracket wall 102, the retaining plate 187 is pivoted upwardly out of the way to permit the top wall 170 to pass thereunder, and then when the container rear wall 133 is against the bracket wall 102, the retaining plate 187 is pivoted back down into engagement with the groove 172 securely to hold the container 130 in place and prevent it from tipping over. It will be understood that, when it is desired to demount the container 130, the retaining plate 187 is pivoted back up to disengage it from the groove 172 and permit removal of the container 130. Thus, the container 130 can be readily mounted on and demounted from the mounting bracket 101 without having to handle any screws or other fasteners, and without the necessity of using any tools whatsoever.

The dispenser 100 is also provided with a cover plate 190 which includes a top wall 191, a front wall 192, a pair of opposed side walls 193 and a rear wall 194 all integrally connected in a unitary structure. Formed in the top wall 191 is a large bowl-like recess which serves as an ashtray 195 substantially centrally of the cover plate 190, the top wall 191 also having formed therein between the ashtray 195 and the front wall 192 a plurality of flutes 196 to serve as cigarette holders. Fixedly secured to the inner surface of the front wall 192 adjacent to the opposite side edges thereof are two projections 197 which are respectively adapted to be received in arcuate recesses for engagement with the retaining faces of the lugs 185 on the container 130. The cover plate 190 is dimensioned so as completely to cover the top wall 170 of the container 130, with the walls 192 through 194 having a depth sufficient to accommodate the inclined flange 109 and the upwardly extending flange 110 of the mounting bracket 101. In use, the projections 197 are inserted in the arcuate recesses of the lugs 185, and the cover plate 190 is then pivoted down into position completely covering the top of the container 130, all as illustrated.

Preferably, the cover plate 190 is provided with a lock mechanism 198 which may be provided with latch fingers 199 adapted to extend through apertures in the mounting bracket flange 110, whereby the engagement of the latch fingers 199 with the bracket flange 110 and the engagement of the projections 197 with the lugs 185 cooperate securely to lock the cover plate 190 in place. It will be seen that when thus positioned on the container 130, the outer surfaces of the walls 192 through 194 are respectively substantially flush with the outer surfaces of the container walls 131 and 132 and the mounting bracket wall 101 to present substantially smooth uninterrupted outer surfaces for the dispenser 100, resulting in a clean, stylish appearance.

Referring to FIGS. 3 through 6 of the drawings, there is illustrated a first form of a fluid injection pouch 200 for use with the dispenser 100 to provide a complete fluid dispensing system, the fluid injection pouch 200 more specifically being useful in replenishing the supply of viscous liquid soap 141 in the chamber 140 through the refill well 175. The pouch 200 includes a flexible plastic wall 201 that is initially tubular in shape, other shapes being also usable, and which after filling with viscous liquid soap 140, is sealed at each end as at 202 to provide a fluid-tight container 205 for viscous liquid soap.

Disposed within the container 205 and in the fluid, and specifically liquid soap 141 disposed therein, is a tubular docking adaptor 210, see particularly FIGS. 5 and 6. The adaptor 210 is cylindrical in shape, circular in cross section, and includes an outer cylindrical wall 211 extending the length thereof, and a cylindrical inner wall 212 also extending the length thereof. It will be appreciated that the adaptor 210 may have a cross section of a different shape. The adaptor 210 terminates at ends 213 at each end thereof, the ends 213 being disposed normal to the longitudinal axis of the tubular docking adaptor 210. The outer size or diameter of the outer wall 211 is slightly less than the inner size or diameter of the inner surface 177 of the refill well 175, and more specifically, the difference in the diameters is slightly less than the thickness of the material forming the pouch wall 201, so that when the parts are in the positions illustrated in FIG. 4, a fluid-tight seal is provided between the inner surface of the pouch wall 201 and the outer surface of the outer wall 211, and between the outer surface of the pouch wall 201 and the inner surface 177 of the refill well 175. The inner size or diameter of the inner wall 212 is slightly greater than the lateral extent of the piercing member 180, and specifically the blades 181, so as to fit thereover. With the parts in the positions illustrated in FIG. 4, a portion of the pouch wall 201 has been forced by the adaptor 210 over the piercing member 180 so as to puncture the pouch wall 201 and to permit discharge of the contents of the pouch 200 through the refill apertures 184 in the bottom of the refill well 175.

There are provided in the adaptor 210 two diamond-shaped drain opening 215 which are spaced from the adjacent end 213 by an equal and predetermined distance. Each of the diamond-shaped openings 215 has four edges 216, two of the edges 216 providing an intersection at a point 217 that is disposed a predetermined distance from the adjacent end 213 of the adaptor 210. More specifically, the point 217 is disposed away from the adjacent adaptor end 213 a distance such that point 217 is disposed well below the upper surface of the top wall 170, and well into the refill well 175 when the parts are in the operative positions illustrated in FIG. 4. This arrangement of the drain openings 215 assures that the last portions of viscous liquid soap in the pouch 200 are injected into the chamber 140 of the dispenser 100.

It is pointed out that the adaptor 210 is essentially symmetrical about a plane normal to the longitudinal axis of the adaptor 210 and intersecting the longitudinal midpoint of the adaptor 210. As a consequence, either of the ends 213 on the adaptor 210 may be inserted into the well 175 to empty the contents of the pouch 200 into the chamber 140. It also is noted that the drain openings 215 are circumferentially displaced 90° with respect to each other so as to strengthen the adaptor 210 as compared to a configuration wherein the drain openings 215 were in longitudinal alignment. It will be appreciated that the drain openings 215 can be circumferentially displaced greater than 90° and up to 180° while retaining this desirable characteristic of maximizing the mechanical strength of the tubular docking adaptor 210.

In a constructional example of the pouch 200, the wall 201 is formed of a plastic, a preferred plastic being polyethylene plastic, having a thickness of about 1.5 mils. The thickness of the plastic may vary from as little as 1 mil. up to as much as 5 mils. while retaining the desirable characteristics of the pouch 200. The portion of the wall 201 forming the container 205 is preferably about 6"×7", and the seals 202 are preferably about 1/8" wide. Other materials may be used in forming the wall 201, such as thin gage metal, fluid-proof paper and the like. The tubular docking adaptor 210 is also preferably formed of plastic, a preferred plastic being polyethylene plastic. The diameter of the outer wall 211 is about $\frac{3}{4}$", while the diameter of the inner wall is slightly greater than $\frac{1}{2}$", and the length of the adaptor 210 is about 3", while the longitudinal point-to-point distance of the drain openings 215 in the longitudinal direction is about $\frac{1}{2}$".

The fluid injection pouch 200 may be used to replenish all types of fluids, and is specifically not limited to the use to replenish liquid soap. Other suitable fluids useful in the present invention are automotive oil, windshield wiper fluid, medical fluids, industrial metal cutting lubricants, chemical additives, etc.

In the use of the pouch 200 to replenish the soap 141 in the chamber 140, the user first lifts the pouch 200 in the condition illustrated in FIG. 3, and through the pouch wall 201 grasps the tubular docking adaptor 210 adjacent to one end thereof, folding a portion of the wall 201 over the other end 213. The cover plate 190 has heretofore been removed from the dispenser 100 so as to expose the refill well 175. The aforementioned other end 213 of the adaptor 210 is then forcefully inserted into the refill well 175. The portion of the pouch wall 201 covering the other end 213 is then pressed against the piercing member 180 and is pierced thereby as the adaptor 210 is driven home into the refill well 175, the parts eventually reaching the positions illustrated in FIG. 4. At this time, a portion of the wall 201 has been pierced as at 206 (see FIG. 4), thus providing the communication between the interior of the pouch container 205 and the refill apertures 184. It is noted that the portion of the pouch wall 201 surrounding the engaged end of the adaptor 210 assists in forming a seal between the outer wall 211 and the inner surface 177 of the refill well 175. The user next squeezes the pouch 200 to force the contents thereof under pressure through the adaptor 210 and then through the refill apertures 184 and into the chamber 140. As was indicated above, the viscous liquid soap will not flow through the refill apertures 184 by gravity, whereby it is necessary for the user forcefully to squeeze the pouch 200 to cause the necessary flow through the refill apertures 184. The drain opening 215 disposed partially in the refill well 175 facilitates the expulsion of the final portions of the contents of the pouch 200 therefrom and through the refill apertures 184 and into the chamber 140. When the pouch 200 has been emptied, the adaptor 210 is grasped through the wall 201 and is pulled upwardly to remove the adaptor 210 and the associated portions of the pouch wall 201 from the refill well 175. The entire pouch 200, including the adaptor 210 is then discarded.

It will be appreciated that the pouch 200 can be stored in a minimum of space, since the wall 201 thereof can deform so as closely to pack a container holding a plurality of the pouches 200. Furthermore, the adaptor 210 is disposed completely within the pouch 200 and the soap 141 contained therein, whereby there is no objectionable protrusion which interferes with packing and storing of the pouch 200. In use, the construction of the pouch 200 and its adaptor 210 assure easy and tidy replenishing of the viscous soap in the container 140 by injecting the contents of the pouch 200 through its adaptor 210 and the pierced portion 206 of the pouch wall 201, and thence through the refill apertures 184 and into the container 140. Since the pouch 200 and all the components thereof including the adaptor 210 are disposable, there is a minimum of difficulty experienced by the user in disposing of the empty pouch 200 and its associated parts.

After the contents of the pouch 200 have been injected into the container 140, the cover plate 190 is replaced, and preferably locked in position by means of the lock mechanism 198. Soap can then again be dispensed from the dispenser 100 by the user actuating the operating handle 151 of the pump assembly. As soon as the level of soap falls to the point where it must be replenished, the refill operation using another pouch 200 and its adaptor 210 is repeated as explained above.

Referring to FIGS. 7 to 10 of the drawings, there is illustrated a second preferred embodiment of an adaptor 310 for use in a pouch 200 of the type discussed above. The adaptor 310 is generally cylindrical in shape, circular in cross section, and includes an outer cylindrical wall 311 and an inner cylindrical wall 312 extending the length thereof. The adaptor 310 terminates at ends 313 at each end thereof, the ends 313 being disposed normal to the longitudinal axis of the tubular docking adaptor 310. The outer diameter of the outer wall 311 is slightly less than the inner diameter of the inner surface 177 of the refill well 175, and more specifically, the difference in the diameters is slightly less than the thickness of the material forming the pouch 200, so that when the parts are in the position illustrated in FIG. 10, a fluid-tight seal is provided between the inner surface of the pouch wall 201 and the outer surface of the outer wall 311, and between the outer surface of the pouch wall 201 and the inner surface 177 of the refill well 175. The inner diameter of the inner wall 312 is slightly greater than the lateral extent of the piercing member 180 and specifically the blades 181, so as to fit thereover.

In order better to seal the space between the outer surface of the outer wall 311 and the inner surface 177 of the refill well 175, annular flexible sealing means is provided adjacent to each end 313 of the adaptor 310 in the form of sealing ribs or flanges 320. The flanges 320 are separated by grooves 322 and the innermost flanges 320 are separated from the outer wall 311 by slightly wider grooves 323. The flanges 320 have relatively small longitudinal dimensions and the material of construction of the adaptor 310 is such that the flanges 320 are flexible and resilient to accomplish the sealing function thereof. With the parts in the position illustrated in FIG. 10, a portion of the pouch wall 201 has been forced by the adaptor 310 over the piercing member 180 so as to puncture the pouch wall 201 and to permit discharge of the contents of the pouch 200 through the refill apertures 184 in the bottom of refill well 175. The sealing flanges 320 serve to maintain a fluid-tight connection between the adaptor 310 and the side wall 174 of the refill well 175.

There are provided in the adaptor 310 four oval-shaped drain openings 315 that extend from adjacent to one end 313 to adjacent to the other end 313. Each of the oval-shaped openings 315 has longitudinally extending side edges 316 joined at each end by a rounded end 317. Each of the rounded ends 317 is spaced from the adjacent adaptor end 313 by an equal and predetermined distance. More specifically, each of the drain opening ends 317 is disposed away from the adjacent adaptor end 313 a distance such that the rounded end 317 is disposed well below the upper surface of the top wall 170, and well into the refill well 175 when the parts are in the operative positions illustrated in FIG. 10. This arrangement of the drain openings 315 assures that the last portions of the viscous liquid soap in the pouch 200 are injected into the chamber 140 of the dispenser 100.

It is pointed out that the adaptor 310 is essentially symmetrical about a plane normal to the longitudinal axis of the adaptor 310 and intersecting the longitudinal midpoint of the adaptor 310. As a consequence, either of the ends 313 on the adaptor 310 may be inserted into the well 175 to empty the contents of the pouch 200 into the chamber 140. It also is noted that the drain openings 315 are circumferentially equidistantly displaced with respect to each other so as to strengthen the adaptor 310 as compared to any other configuration thereof.

In a constructional example of the tubular docking adaptor 310, it is preferably formed of plastic, the preferred plastic being polyethylene plastic. The diameter of the outer wall 311 is about $\frac{3}{4}''$, while the diameter of the inner wall is about $\frac{5}{8}''$, and the length of the adaptor 310 is about 3". The drain openings 315 have a longitudinal extent of $\frac{3}{4}''$ and a width at the greatest width thereof of $\frac{1}{4}''$. Each of the sealing flanges 320 has a longitudinal extent of 0.03", the grooves 322 have a longitudinal extent of about 0.10", and the grooves 323 have a longitudinal extent of about 0.16". The grooves 322 and 323 have depths of about 0.06".

The use of a pouch 200 provided with the adaptor 310 to replenish the soap 141 in the chamber 140 is the same as that described above with respect to a pouch 200 with an adaptor 210 therein. The only significant difference between the operation of the adaptor 210 and the adaptor 310 is the slightly better liquid-tight seal provided by the sealing flanges 320 on the adaptor 310. A pouch 200 provided with the adaptor 310 has all of the advantages and characteristics discussed above with respect to a pouch 200 provided with an adaptor 210.

While there have been described what at present are considered to be the preferred embodiments of the invention, it will be understood that various modifications may be made therein, and it is intended to cover in the appended claims all such modifications as fall within the true spirit and scope of the invention.

What is claimed is:

1. A fluid injection pouch comprising a flexible encompassing wall sealed to form a hollow flexible container with a quantity of fluid therein, and a hollow and generally cylindrical docking adaptor having a drain opening therein disposed away from each end thereof loosely disposed within said pouch, said locking adaptor being symmetrical about a plane normal to the axis thereof at the midpoint thereof and including an outer generally cylindrical wall and an inner generally cylindrical wall, said flexible encompassing wall being foldable about said docking adaptor to permit a user to grasp said docking adaptor to press one end thereof and an area of said flexible encompassing wall into a piercing docking adaptor device on a dispenser for connecting the interior of said fluid injection pouch with a dispenser for the contents thereof.

2. The fluid injection pouch set forth in claim 1, wherein said flexible encompassing wall is formed of a flexible plastic.

3. The fluid injection pouch set forth in claim 1, wherein said flexible encompassing wall is formed of a polyethylene plastic having a thickness in the range from about 1 mil to about 5 mils.

4. The fluid injection pouch set forth in claim 1, wherein said tubular docking adaptor is formed of polyethylene plastic.

5. The fluid injection pouch set forth in claim 1, wherein said tubular docking adaptor is circular in cross section.

6. The fluid injection pouch set forth in claim 1, wherein a drain opening is disposed adjacent to each end of said docking adaptor.

7. The fluid injection pouch set forth in claim 6, wherein said drain openings are angularly displaced with respect to each other about the circumference of said docking adaptor.

8. The fluid injection pouch of claim 1, and further comprising an annular flexible sealing means projecting radially outwardly from said tubular docking adaptor.

9. A system for dispensing fluid, said system comprising a closed wall structure defining a vessel, dispensing means carried by said vessel for dispensing fluid therefrom, said wall structure having a recessed portion forming a refill well including a side wall portion extending inwardly of said container and an inner wall portion closing the inner end of said side wall portion, a piercing member carried by said inner wall portion and projecting therefrom outwardly into said refill well, said inner wall portion having a refill aperture therethrough and providing direct communication with the interior of said vessel, a fluid injection pouch including a flexible encompassing wall sealed to form a hollow flexible container with a quantity of fluid therein, and a hollow and generally cylindrical docking adaptor having a drain opening therein disposed away from each end thereof loosely disposed within said pouch and including an outer wall having an outer size slightly less than the inner size of said side wall portion of said refill well so as to fit thereinto with the flexible wall of said pouch disposed between the inner surface of said wall portion of said refill well and the outer surface of said outer wall to form a seal therebetween, said docking adaptor being symmetrical about a plane normal to the axis thereof at the midpoint thereof and including an inner wall having an inner size slightly greater than the lateral extent of said piercing member so that said docking adaptor can be pushed into said well and over said piercing member, a portion of said flexible wall overlying the end of said docking adaptor as it is inserted into said refill well receiving said piercing member in piercing relationship therethrough, whereby fluid may flow from said injection pouch through said refill aperture while being prevented from flowing around said docking adaptor disposed within said refill well and out of said refill well by the seal provided by the portion of said flexible wall disposed between the inner surface of said side wall portion and the outer surface of said outer well.

10. The system for dispensing fluid set forth in claim 9, and further including a cover plate releasably mounted on said vessel over said refill aperture for covering thereof.

11. The system for dispensing fluid set forth in claim 9, wherein said wall structure includes a plurality of said refill apertures therethrough.

12. The system for dispensing fluid set forth in claim 9, wherein said piercing member includes four upwardly directed blades arranged in a cruciform configuration and respectively provided with knife edges intersecting at a central point, each of said knife edges being inclined downwardly and outwardly away from said intersection point, said wall structure having a plurality of said refill apertures therethrough arranged between said blades.

13. The system for dispensing fluid set forth in claim 9, wherein said piercing member extends axially of said side wall portion of said refill well a distance equal only to approximately one-half the axial length thereof.

14. The system for dispensing fluid set forth in claim 9, wherein said flexible encompassing wall is formed of a flexible plastic.

15. The system for dispensing fluid set forth in claim 9, wherein said tubular docking adaptor is formed of polyethylene plastic.

16. A system for dispensing fluid, said system comprising a closed wall structure defining a vessel, dispensing means carried by said vessel for dispensing fluid therefrom, said wall structure having a recessed portion forming a refill well including a side wall portion extending inwardly of said container and an inner wall portion closing the inner end of said side wall portion, a piercing member carried by said inner wall portion and projecting therefrom outwardly into said refill well, said inner wall portion having a refill aperture therethrough providing unobstructed direct communication with the interior of said vessel, a fluid injection pouch including a flexible encompassing wall hermetically sealed to form a hollow flexible container with a quantity of fluid therein, and a docking adaptor disposed within said pouch and including an essentially smooth outer wall having an outer size slightly less than the inner size of said side wall portion of said refill well so as to fit thereinto with the flexible wall of said pouch disposed between the inner surface of said side wall portion of said refill well and the outer surface of said outer wall to form a seal therebetween, said docking adaptor including an inner wall having an inner size slightly greater than the lateral extent of said piercing member so that said docking adaptor can be pushed into said well and over said piercing member, said docking adaptor having a drain opening disposed adjacent to each end thereof, a portion of said flexible wall overlying the end of said docking adaptor as it is inserted into said refill well receiving said piercing relationship therethrough, whereby fluid may flow from said injection pouch through said refill aperture while being prevented from flowing around said docking adaptor disposed within said refill well and out of said refill well by the seal provided by the portion of said flexible wall disposed between the inner surface of said side wall portion and the outer surface of said outer wall.

17. The system for dispensing fluid set forth in claim 16, wherein said docking adaptor is symmetrical about a plane normal to the axis thereof at the midpoint thereof, whereby either end of said docking adaptor may be inserted into said refill well.

18. The system for dispensing fluid set forth in claim 16, and further comprising a drain opening in said docking adaptor positioned to communicate with the end of said refill well disposed away from said inner wall portion thereof.

19. The system for dispensing fluid set forth in claim 16, wherein said drain openings are angularly disposed with respect to each other about the circumference of said docking adaptor.

20. A system for dispensing fluid, said system comprising a closed wall structure defining a vessel, dispensing means carried by said vessel for dispensing fluid therefrom, said wall structure having a recessed portion forming a refill well including a side wall portion extending inwardly of said container and an inner wall portion closing the inner end of said side wall portion, a piercing member carried by said inner wall portion and projecting therefrom outwardly into said refill well, said inner wall portion having a refill aperture therethrough and providing direct communication with the interior of said vessel, a fluid injection pouch including a flexible encompassing wall sealed to form a hollow flexible container with a quantity of fluid therein, and a docking adaptor loosely disposed within said pouch and including an outer wall having an outer size slightly less than the inner size of said side wall portion of said refill well so as to fit thereinto with the flexible wall of said pouch disposed between the inner surface of said side wall portion and the outer surface of said outer wall, annular flexible sealing means projecting radially outwardly from said docking adaptor and being dimensioned and adapted to be received in said refill well in encircling relationship with said refill aperture and said piercing member and with said sealing means pressing the adjacent flexible wall into sealing engagement with said side wall portion, said docking adaptor including an inner wall having an inner size slightly greater than the lateral extent of said piercing member so that said docking adaptor can be pushed into said refill well and over said piercing member, said docking adaptor having a drain opening disposed adjacent each end thereof, a portion of said flexible wall overlying the end of said docking adaptor as it is inserted into said refill well and receiving said piercing member in piercing relationship therethrough, whereby fluid may flow from said injection pouch through said refill aperture while being prevented from flowing around said docking adaptor disposed within said refill well and out of said refill well by the seal provided by said sealing means and the portion of said flexible wall disposed against the inner surface of said side wall portion.

21. The system for dispensing viscous liquid soap set forth in claim 20, wherein said adaptor is symmetrical about a plane normal to the axis thereof at the midpoint thereof, whereby either end of said tubular docking adaptor may be inserted into said refill well.

22. The system for dispensing viscous liquid soap set forth in claim 20, and further comprising a drain opening in said adaptor communicating with the end of said refill well disposed away from said inner wall portion.

23. The system for dispensing fluid set forth in claim 20, wherein four drain openings are provided equidistantly spaced around the circumference of said docking adaptor.

24. The system for dispensing fluid set forth in claim 20, wherein said drain opening extends to adjacent each end of said docking adaptor, whereby a drain opening is provided regardless of which end of said docking adaptor is inserted in said refill well.

25. A system for dispensing viscous liquid soap, said system comprising a closed wall structure defining a soap vessel, dispensing means carried by said soap vessel for dispensing viscous liquid soap therefrom, said wall structure having a recessed portion forming a refill well including a generally cylindrical side wall portion extending inwardly of said container and an inner wall portion closing the inner end of said cylindrical side wall portion, a piercing member carried by said inner wall portion and projecting therefrom outwardly into said refill well, said inner wall portion having a normally open refill aperture therethrough spaced laterally from said piercing member and providing unobstructed direct communication with the interior of said vessel thereby normally to equalize the pressures inside and outside of said vessel, said aperture being dimensioned readily to permit the flow of air while substantially to inhibit the flow of viscous liquid soap between the outside and the inside of said vessel at equal pressures inside and outside of said vessel, a viscous liquid soap injection pouch including a flexible encompassing wall hermetically sealed to form a hollow flexible container with a quantity of viscous liquid soap therein, and a tubular docking adaptor loosely disposed within said pouch and including an outer wall having an outer diameter slightly less than the inner diameter of said side wall portion of said refill well so as to fit thereinto with the flexible wall of said pouch disposed between the inner surface of said side wall portion and the outer surface of said outer wall, annular flexible sealing means projecting radially outwardly from said tubular docking adaptor and being dimensioned and adapted to be received in said refill well in encircling relationship with said refill aperture and said piercing member and with said sealing means pressing the adjacent flexible wall into sealing engagement with said cylindrical side wall portion, said tubular docking adaptor including an inner wall having an inner diameter slightly greater than the lateral extent of said piercing member so that said tubular docking adaptor can be pushed into said refill well and over said piercing member, said docking adaptor having a drain opening disposed adjacent each end thereof, a portion of said flexible wall overlying the end of said tubular docking adaptor as it is inserted into said refill well and receiving said piercing member in piercing relationship therethrough, whereby viscous liquid soap may flow from said injection pouch and around said piercing member and be forced through said refill aperture under pressure greater than that in said vessel while being prevented from flowing around said tubular docking adaptor disposed within said refill well and out of said refill well by the seal provided by said sealing means and the portion of said flexible wall disposed against the inner surface of said side wall portion.

* * * * *